US010786911B2

(12) United States Patent
Wynne et al.

(10) Patent No.: US 10,786,911 B2
(45) Date of Patent: Sep. 29, 2020

(54) KNIVES

(71) Applicant: DKB HOUSEHOLD UK LIMITED, Hampshire (GB)

(72) Inventors: Andrew Wynne, Cambridge (GB); Andrew Stockdale, Cambridge (GB); Nicki Sutton, Cambridge (GB); James Davies, Cambridge (GB)

(73) Assignee: DKB HOUSEHOLD UK LIMITED (GB)

( * ) Notice: Subject to any disclaimer, the term of this patent is extended or adjusted under 35 U.S.C. 154(b) by 0 days.

(21) Appl. No.: 16/324,623

(22) PCT Filed: Aug. 10, 2017

(86) PCT No.: PCT/EP2017/070386
§ 371 (c)(1),
(2) Date: Feb. 11, 2019

(87) PCT Pub. No.: WO2018/029322
PCT Pub. Date: Feb. 15, 2018

(65) Prior Publication Data

US 2019/0176350 A1 Jun. 13, 2019

(30) Foreign Application Priority Data

Aug. 11, 2016 (EP) ..... 16183889

(51) Int. Cl.
*B26B 9/00* (2006.01)
*B26B 3/00* (2006.01)

(52) U.S. Cl.
CPC . *B26B 9/00* (2013.01); *B26B 3/00* (2013.01)

(58) Field of Classification Search
CPC ..... B26B 9/00; B26B 3/00
USPC ..... 30/340
See application file for complete search history.

(56) References Cited

U.S. PATENT DOCUMENTS

| | | | | | |
|---|---|---|---|---|---|
| 492,409 | A | * | 2/1893 | May | |
| 1,967,479 | A | * | 7/1934 | Platts | B26B 3/00 279/95 |
| 1,998,044 | A | * | 4/1935 | Brown | B26B 3/00 30/342 |
| D202,780 | S | * | 11/1965 | Baer | D22/118 |
| 5,058,305 | A | | 10/1991 | Majesty | |
| 5,365,666 | A | | 11/1994 | Gonzalez | |
| D766,672 | S | * | 9/2016 | Mishan | D7/649 |
| D790,288 | S | * | 6/2017 | Singer | D7/401.2 |
| D790,289 | S | * | 6/2017 | Singer | D7/401.2 |

(Continued)

FOREIGN PATENT DOCUMENTS

DE 10 2010 049 952 A1 * 4/2012

OTHER PUBLICATIONS

International Search Report and Written Opinion for PCT Application No. PCT/EP2017/070386, dated Nov. 16, 2017, 14 pages.

*Primary Examiner* — Hwei-Siu C Payer
(74) *Attorney, Agent, or Firm* — Dorsey & Whitney LLP

(57) ABSTRACT

A knife (10) having a body (16) with a handle (14) and a blade (12), the blade having two sides (22), an upper edge (18) and a sharp lower edge (20) for cutting, the body having an upper side which includes at least two indentations (42, 48) which are spaced apart from one another, wherein at least one of the indentations is formed in the upper edge of the blade.

24 Claims, 3 Drawing Sheets

(56) References Cited

U.S. PATENT DOCUMENTS

| | | | | |
|---|---|---|---|---|
| D792,152 | S * | 7/2017 | Wynne | D7/401.2 |
| D793,174 | S * | 8/2017 | Wynne | D7/401.2 |
| 2002/0023359 | A1* | 2/2002 | Peppel | B25G 1/102 30/340 |
| 2004/0123471 | A1 | 7/2004 | Onion | |
| 2005/0115083 | A1* | 6/2005 | Lauridsen | B25G 1/102 30/340 |
| 2007/0214651 | A1* | 9/2007 | Thun | B26B 3/00 30/142 |
| 2012/0159793 | A1* | 6/2012 | Hatch | B26B 3/00 30/312 |
| 2012/0192434 | A1 | 8/2012 | Syrjala | |
| 2019/0176350 | A1* | 6/2019 | Wynne | B26B 9/00 |

* cited by examiner

KNIVES

CROSS-REFERENCE TO RELATED APPLICATIONS

This application is the national stage application of International Patent Application No. PCT/EP2017/070386, filed on Aug. 10, 2017, and entitled "Knives" which claims priority to European Patent Application No. 16183889.1, filed on Aug. 11, 2016 and entitled "Knives," the entire contents of which are hereby incorporated by reference herein in their entireties.

The present invention relates to knives, in particular knives which may be used as kitchen utensils or for food preparation, such as for chopping vegetables, fruit or other foodstuffs.

A known knife comprises a body with a handle and a blade, the blade having two sides, an upper edge and a sharp lower edge for cutting. Knives like this have been used relatively effectively for many years but they can be difficult to control, for example when trying to chop up chives or herbs or other items such as carrots into very thin slices.

The present invention aims to alleviate at least to a certain extent the problems of the prior art. Alternatively, the present invention aims to provide a useful knife.

According to a first aspect of the invention there is provided a knife having a body with a handle and a blade, the blade having two sides, an upper edge and a sharp lower edge for cutting, the body having an upper side which includes at least two indentations which are spaced apart from one another, wherein at least one of the indentations is formed in the upper edge of the blade. This is extremely useful since the indentation on the upper edge of the blade can be contacted by the hand of a user, such as by a finger, for example to push down gently on the upper edge of the blade and to control chopping motion.

At least one of the indentations may be located at a forward region of the handle. This can be positioned for engagement by a hand gripping the handle. This is advantageous since an indentation in the forward region of the handle can be conveniently engaged by the thumb or a finger of a user and in combination the user can use the other hand to engage the indentation formed on the upper edge of the blade, therefore controlling the knife very accurately, for example for chopping up of chives, other herbs, carrots or other vegetables or fruit or other foodstuffs with significant control, using two hands.

This indentation located at a forward region of the handle, when viewed sideways from a left side towards a right side of the knife, may have a cross-section which is curved and concave. Advantageously, the curve may substantially match with an intended cooperating hand portion of a user, such as the underneath of a thumb or finger of a user which may be used to press down on this indentation located at a forward region of the handle. Furthermore, in a cross-section across the knife perpendicular to its longitudinal direction and through sideways across the knife, the indentation located at a forward region of the handle may be concave, or slightly convex, or substantially flat.

The concave cross-section may have a portion which may be substantially circular, substantially with a radius less than 5 cm, typically less than 3 cm, e.g. about 1 cm to 2 cm for engagement by a thumb or finger of a hand gripping the handle. With the portion substantially having a radius of 1 to 2 cm, the thumb or finger of a user can very effectively engage a large portion or all of the surface area of this indentation, the user may feel from this that the thumb or finger and hand generally is correctly positioned on the knife and may also press down on the indentation while engaged in a chopping action.

In a cross-section across the knife perpendicular to its longitudinal direction and through sideways across the knife, the indentation located at a forward region of the handle may have a distinct curvature or shape which is different to portions of the handle on either side thereof. Additionally, this indentation may encompass only a partial segment of the perimeter of said cross-section. Advantageously, this may allow for quick and easy location of this indentation by the user.

Each of the two sides of the blade may include a substantially flat main portion. In this case, the substantially flat portions of the two sides may be arranged tapering towards each other in a downward direction towards the sharp lower edge. The lower edge may be taper/wedge ground. In an alternative embodiment the blade may be hollow ground or have another grind applied, the substantially flat main portions may in other embodiments be substantially parallel to one another and at least one chamfered cheek or ground area may be provided leading down towards the sharp edge which may be ground in various different ways, e.g. taper/wedge or hollow ground.

The upper edge and sharp lower edge of the knife may meet at a point.

The at least one indentation formed in the upper edge of the blade may be located nearer the point than where the substantially flat main portions of the blade approach the handle.

The curvature of the sharp lower edge of the blade may be greater below the indentation formed in the upper edge of the blade than the curvature of the sharp lower edge at a point nearer the handle.

Advantageously, this allows the indentation formed in the upper edge of the blade to be located near what is substantially a pivot point when the knife is positioned for a vertical cut and is rocked with the handle moving up and down and the sharp edge cutting through foodstuff and continually substantially engaged with a chopping board or other cooperating surface under the foodstuff. The user can place one or more fingers of one hand resting on the indentation formed on the upper edge of the blade substantially at this area of generally pivoting motion in the forward/backward direction along the knife and the other hand can be used to rock the knife up and down using the handle to perform a fast chopping action which may be an easily controlled sequence of very finely controlled and thin chops, especially when the thumb or finger of a hand gripping the handle is used on the indentation at a forward region of the handle.

The indentation formed in the upper edge of the blade, when viewed sideways from a left side towards a right side of the knife, may have a cross-section which is curved and concave. This advantageously allows the user to feel where the indentation is and the indentation is not sharp or likely to damage the hand of the user.

The cross-section of the indentation formed in the upper edge of the knife may have a portion which is substantially circular, substantially with a radius more than 5 cm, typically more than 6 or 7 cm, about 8 to 12 cm or about 10 cm. Advantageously, the user may be able to place two or three fingers, such as two or three out of the index, middle and ring fingers, on the indentation formed in the upper edge of the knife, the curvature of the indentation and its size enabling the user to feel easily the position of this hand on the knife and the orientation of the knife relative to the hand.

The radius of the indentation formed in the upper edge of the knife blade may be larger than the radius of an indentation formed in the forward region of the handle. Advantageously, it may therefore be easily recognisable by the user that the two indentations are for the placing of different hand parts and different numbers of hand parts on the two indentations, for example, the thumb or finger on the indentation formed at the forward region of the handle and two or three fingers on the indentation formed in the upper edge of the knife blade.

The indentation formed in the upper edge of the blade along the length of the upper edge may be more than 2 cm, typically more than 3 or 4 cm, about 4 to 6 cm long being one preferred range. Advantageously, with this indentation about 4 to 6 cm long, a majority of adult users of the knife or at least an adult user with a hand of average size may easily engage two or three fingers and/or thumb of one hand in this indentation.

The upper edge of the blade may have a distinct width and may be blunt at least in the region of the indentation formed therein. Advantageously, despite the knife overall being a sharp instrument with which considerable care must be taken, the blunt upper edge which can thus be noticeably blunt to the user can clearly, to the user, be safe for engagement by the hand and in particular pushing down on it. In some preferred embodiments, the distinct width of the upper edge may vary in length along the knife blade but in the region of the indentation may be more than 0.5 mm, at least part of this region may be more than 1 or 1.5 mm wide, some portions being up to about 2 mm wide or more across the knife upper edge. At least some of these examples may be with chefs' knives in which the upper edge of the blade is in the region of 10 to 25 cm long, for example within the region of about 12 to 20 cm long. The total length of the knife including its handle may in some cases be from about 170 to 400 mm long, for example 250 to 350 mm long, one example being about 320 mm long, although other lengths being envisaged.

The upper edge of the blade, apart from the indentation, may include at least one substantially straight portion which may extend towards a handle region from the indentation in the upper edge, and may have an upwardly convex portion leading to a point of the knife.

The blade of the knife may have a first end forming a point of the blade and a second end which is adjacent to the handle of the knife. The at least one indentation formed in the upper edge of the blade may be located nearer to the first end of the blade than the second end of the blade. Advantageously, this allows the indentation formed in the upper edge of the blade to be located near what is substantially a pivot point when the knife is positioned for a vertical cut and is rocked with the handle moving up and down and the sharp edge cutting through foodstuff and continually substantially engaged with a chopping board or other cooperating surface under the foodstuff. The user can place one or more fingers of one hand resting on the indentation formed on the upper edge of the blade substantially at this area of generally pivoting motion in the forward/backward direction along the knife and the other hand can be used to rock the knife up and down using the handle to perform a fast chopping action which may be an easily controlled sequence of very finely controlled and thin chops, especially when the thumb or finger of a hand gripping the handle is used on the indentation at a forward region of the handle.

The upper edge of the blade, when viewed sideways from a left side towards a right side of the knife, may be substantially straight or straight except for the at least one indentation formed in the upper edge of the blade. The upper edge of the blade may have a first portion extending from the first end of the blade to the at least one indentation formed in the upper edge of the blade, and a second portion extending from the second end of the blade to the at least one indentation formed in the upper edge of the blade. The second portion of the substantially straight upper edge of the blade may extend over at least or more than half of the length of the upper edge of the blade. The first and second portions of the substantially straight upper edge of the blade may be aligned to be substantially level and parallel with each other, when viewed sideways from a left side towards a right side of the knife. Advantageously, this allows the indentation formed in the upper edge of the blade to be located near what is substantially a pivot point when the knife is positioned for a vertical cut and is rocked with the handle moving up and down and the sharp edge cutting through foodstuff and continually substantially engaged with a chopping board or other cooperating surface under the foodstuff. The user can place one or more fingers of one hand resting on the indentation formed on the upper edge of the blade substantially at this area of generally pivoting motion in the forward/backward direction along the knife and the other hand can be used to rock the knife up and down using the handle to perform a fast chopping action which may be an easily controlled sequence of very finely controlled and thin chops, especially when the thumb or finger of a hand gripping the handle is used on the indentation at a forward region of the handle.

An upper side of the handle of the knife may have a portion adjacent to the blade wherein the upper side of the handle is aligned to be substantially level with the upper edge of the blade, when viewed sideways from a left side towards a right side of the knife.

The lower edge of the blade may taper upwards to meet the upper edge of the blade at a point.

An upper edge of the at least one indentation formed in the upper edge of the blade may be unitary with and fabricated from the same material as the blade, and may be configured for direct contact with a hand. Advantageously, this may provide for comfortable use of the knife, combined with good hygiene and easy cleaning.

The sharp lower edge of the blade may have a rear end portion, an imaginary line of extension of which, in a rearward direction away from a point of the knife, may extend below the handle. Advantageously, this may provide for the user to use the blade of the knife in a generally pivoting motion in the forward/backward direction along the knife, whilst rocking the handle of the knife up and down, to perform a fast chopping action which may be an easily controlled sequence of very finely controlled and thin chops. According to a second aspect of the invention there is provided a knife having a body with a blade, the blade having two sides, an upper edge and a sharp lower edge for cutting, the body having an upper side which includes at least one discontinuity such as an indentation, each of the two sides of the blade including a substantially flat main portion, the upper edge and sharp lower edge of the knife meeting at a point, the discontinuity being formed in the upper edge and being nearer the point than a rear end of each main portion. Advantageously, even without any indentation on a handle, the knife blade may have the useful functionality described above for the indentation on the upper edge of the blade.

Instead of being an indentation, the discontinuity may comprise a raised portion or in some case a widened portion of the upper edge. The blade in this case may be formed integrally with a handle or it may be a simple blade unit, for example one of a set of blade units which may be connectable and disconnectable from one or more separate handle units which are additional items. The discontinuity may comprise a platform, texture, hump or recess.

The upper edge of the blade, when viewed sideways from a left side towards a right side of the knife, may be substantially straight except for the at least one indentation, which is formed in the upper edge of the blade. The upper edge of the blade may have a first portion extending from the point of the blade to the at least one indentation formed in the upper edge of the blade, and a second portion which is substantially straight or straight when viewed in a direction sideways from a left side towards a right side of the knife and extends from the second end of the blade to said at least one indentation formed in the upper edge of the blade. The second portion of the substantially straight upper edge of the blade may extend over at least or more than half of the length of the upper edge of the blade. The first and second portions of the substantially straight upper edge of the blade may be aligned to be substantially level and parallel with each other, when viewed sideways from a left side towards a right side of the knife. Advantageously, this allows the indentation formed in the upper edge of the blade to be located near what is substantially a pivot point when the knife is positioned for a vertical cut and is rocked with the handle moving up and down and the sharp edge cutting through foodstuff and continually substantially engaged with a chopping board or other cooperating surface under the foodstuff. The user can place one or more fingers of one hand resting on the indentation formed on the upper edge of the blade substantially at this area of generally pivoting motion in the forward/backward direction along the knife and the other hand can be used to rock the knife up and down using the handle to perform a fast chopping action which may be an easily controlled sequence of very finely controlled and thin chops, especially when the thumb or finger of a hand gripping the handle is used on the indentation at a forward region of the handle.

The knife may further comprise a handle, wherein an upper side of the handle has a portion adjacent to the blade which is aligned to be substantially level with the upper edge of the blade, when viewed sideways from a left side towards a right side of the knife.

The lower edge of the blade may taper upwards to meet the upper edge of the blade at the point.

An upper edge of the at least one indentation formed in the upper edge of the blade may be unitary with and fabricated from the same material as the blade, and may be configured for direct contact with a hand. Advantageously, this may provide for comfortable use of the knife, combined with good hygiene and easy cleaning.

At least one of the indentations may be located at a forward region of a handle of the knife body for engagement by a hand gripping the handle. This indentation, when viewed sideways from a left side towards a right side of the knife, may have a cross-section which is curved and concave. Furthermore, in a cross-section across the knife perpendicular to its longitudinal direction and through sideways across the knife, the indentation located at a forward region of the handle may be concave, or slightly convex, or substantially flat.

In a cross-section across the knife perpendicular to its longitudinal direction and through sideways across the knife, the indentation located at a forward region of the handle may have a distinct curvature or shape which is different to portions of the handle on either side thereof. Additionally, this indentation may encompass only a partial segment of the perimeter of said cross-section. Advantageously, this may allow for quick and easy location of this indentation by the user.

The sharp lower edge of the blade may have a rear end portion, an imaginary line of extension of which, in a rearward direction away from a point of the knife, may extend below the handle. Advantageously, this may provide for the user to use the blade of the knife in a generally pivoting motion in the forward/backward direction along the knife, whilst rocking the handle of the knife up and down, to perform a fast chopping action which may be an easily controlled sequence of very finely controlled and thin chops. The present invention may be carried out in various ways and a preferred embodiment of a knife in accordance with the invention will now be described by way of example only and with reference to the accompanying drawings, in which:

Figure 1:
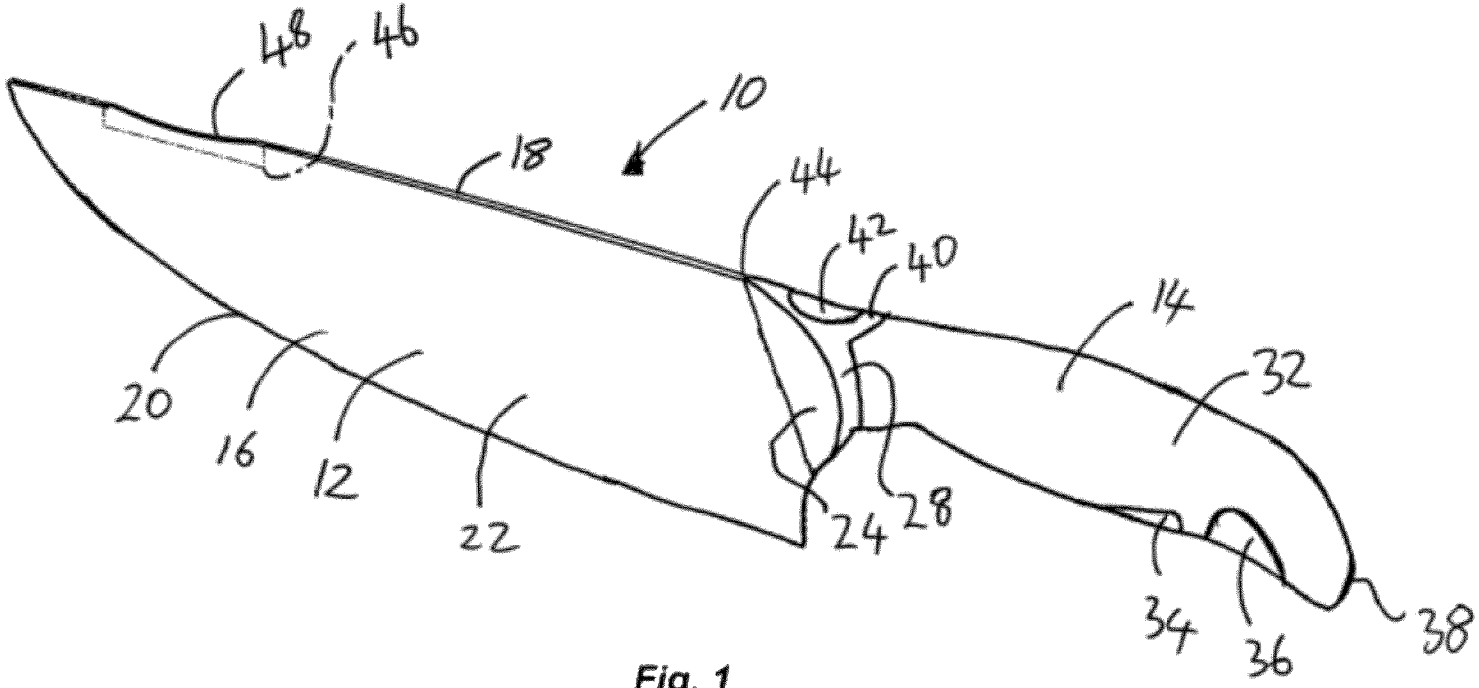
FIG. 1 is a perspective view of a preferred embodiment of a knife in accordance with the present invention.
Figure 2:
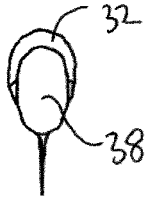
FIG. 2 is a rear elevation of the knife shown in FIG. 1.

As shown in FIG. 1, a chef's knife 10 includes a blade 12 and a handle 14.

The blade 12 includes a main body portion 16 with a top edge 18, a sharp lower edge 20 and flat sides 22.

Figure 3:
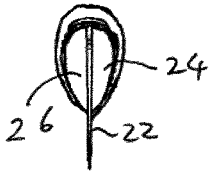
FIG. 3 is a front elevation of the knife shown in FIGS. 1 and 2.

The flat sides 22 taper towards each other in the downward direction as shown in FIG. 3 and the sharp lower edge 20 is a wedge-ground formation about 1 to 2 mm in height formed by grinding the flat sides 22.

Figure 4:
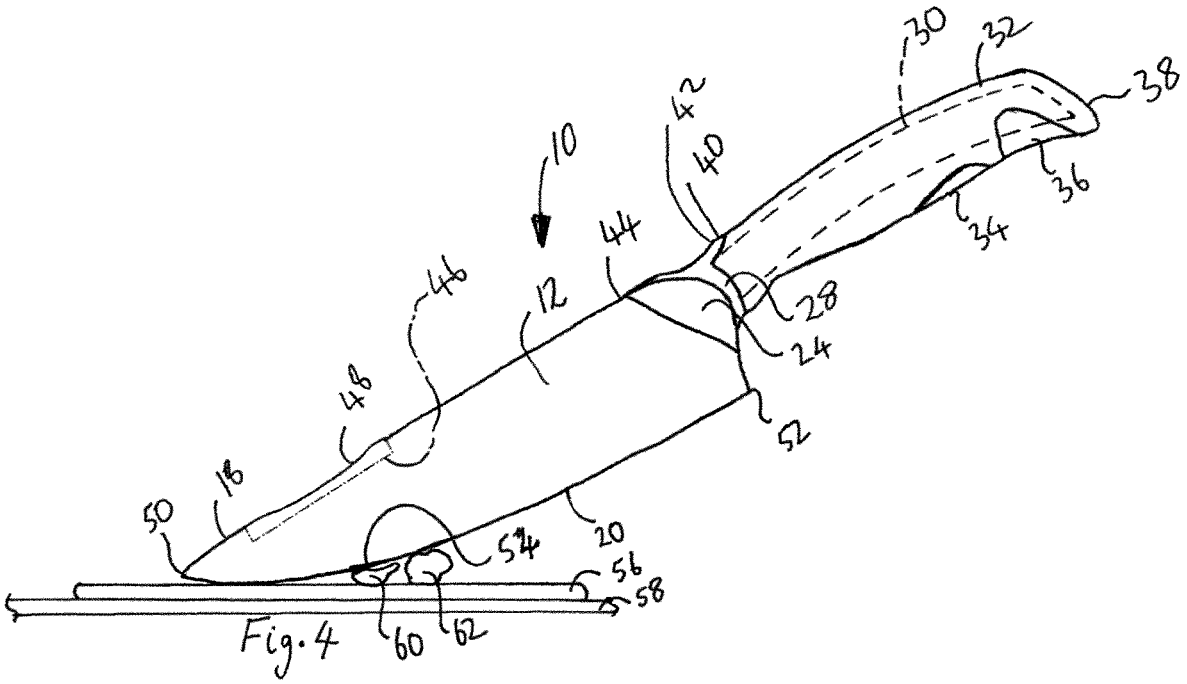
FIG. 4 shows the knife of FIGS. 1 and 3 in side elevation and as being used to chop vegetables located on a cutting board on a worktop.
Figure 5:
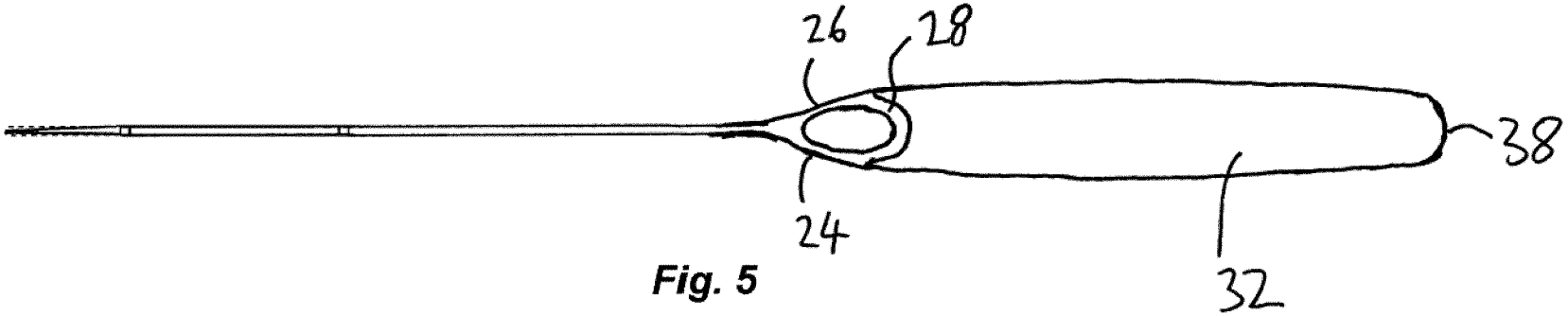
FIG. 5 is a top plan view of the knife shown in FIGS. 1 to 4.
Figure 6:
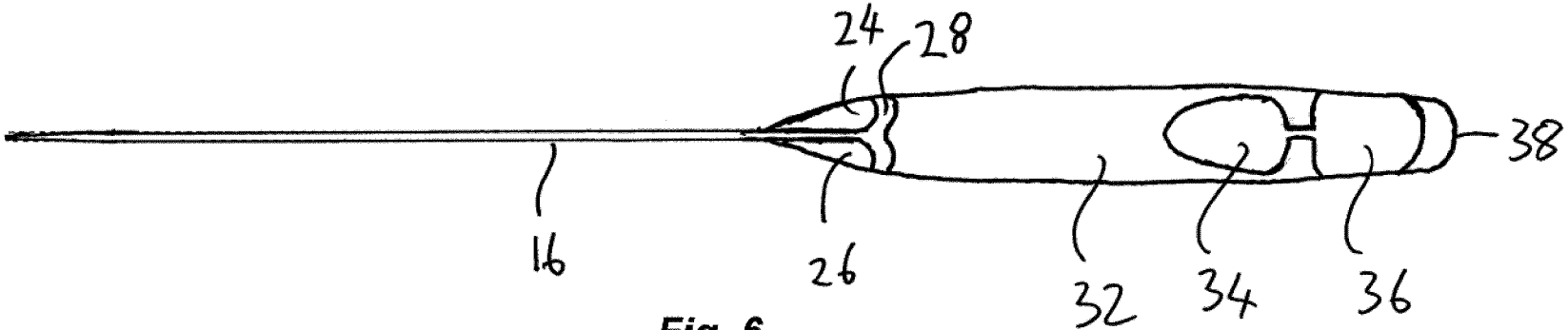
FIG. 6 is a bottom plan of the knife shown in FIGS. 1 to 5.

The main body portion 16 is made of steel integrally with flaring side chamfers 24, 26, a handle abutment or connection portion 28 and a handle tail or tang 30 which is not shown other than in dashed lines in FIG. 4. The tang 30 is encased in a relatively hard plastics handle grip 32 which is co-moulded with relatively soft plastics grip portions 34, 36, the handle grip 32 having a butt end 38. The grip portions 34, 36 may be arranged for engagement by particular fingers of a human hand, for example by the ring and little fingers (not shown).

A top portion 40 of the handle connection portion 28 includes an indentation or thumb/finger recess 42 which as seen in the side view of FIG. 4 has a curved concave upwardly facing cross-section or shape so that it is comfortably engageable by a thumb or finger of a human hand (not shown) for pushing down on the knife 10. The cross-section or shape of the thumb or finger recess 42 when viewed from the side as shown in FIG. 4 may be arcuate or radiussed, substantially with a radius in the region of 1 to 2 cm.

The top edge 18 of the blade 12 has a width at a rear portion 44 of the main body portion 16 of about 2 to 3 mm and the width of the top edge may be constant or narrowing and tapering towards a discontinuity portion 46 of the top edge 18 which includes a discontinuity 48 in the form of an indentation in the top edge 18 of the blade 12. The discontinuity 48 as shown in FIG. 4 has an upwardly concave shape and is curved or arcuate when viewed from the side as in FIG. 4, the top edge 18 at the discontinuity 48 nevertheless still being blunt and having a width of about 1½ to 2 mm. The concave cross-section of the discontinuity 48 may be substantially a radius which may be substantially larger than that of the thumb or finger recess 42, the radius of the discontinuity 48 in this specific embodiment being about 10 to 12 cm although this may vary in other embodiments. The length of the discontinuity 48 between two ends of its concavity in this specific embodiment is about 4.5 cm enabling about two or three fingers of an average-sized adult hand to rest in the discontinuity 48.

In other embodiments, instead of being an indentation, the discontinuity 48 may consist of a platform, a texture, hump or other discontinuity formed on the top edge 18, especially for being useful for the guidance by touch of one or more, typically two or three, fingers of an average-sized adult hand to be positioned on the discontinuity and to push down on and otherwise control the top edge 18 during cutting operations.

As shown in the side view of FIG. 4, the sharp lower edge 20 of the blade 12 meets the top edge 18 at a sharp point 50. The discontinuity 48 is near the point, e.g. nearer than it is to the handle grip 32. The sharp lower edge 20 becomes more curved leading from a rear end 52 thereof towards a region 54 thereof near the discontinuity portion 46. The sharp lower edge (20) of the blade (12) may have a rear end portion, an imaginary line of extension of which, in a rearward direction away from a point of the knife, may extend below the handle (14). This means that when the knife 10 is held in one hand and placed on a chopping board 56 on a worktop 58 with the blade 12 substantially vertical for substantially vertical cutting of foodstuffs 60, 62, the region 54 of the lower edge 20 near the discontinuity portion 46 may act roughly as a pivot point as the sharp lower edge 20 is rolled along the chopping board 56. With one hand on the handle grip 32 and its thumb or finger engaged in the thumb or finger recess 42 and the other hand having two or three fingers resting or pushing on the discontinuity 48, the latter hand may easily feel the position of the discontinuity 48 and also be in the region of roughly a pivot point for the blade 12. It will be appreciated that the motion is not a true pivoting action though since the sharp lower edge 20 can be rolled along the chopping board in either direction or pushed or pulled along it for a slicing action. With two hands controlling the knife and the hand engaging the discontinuity 48 safely feeling its position there, the user can control the knife very well to chop up and down with a rolling action of the sharp lower edge 20 along the chopping board 56 or indeed a slicing action in which there is slip of the sharp lower edge 20 relative to the foodstuffs 60, 62 for quick and accurate chopping of the foodstuff. The foodstuff may comprise vegetables or fruits or other foodstuffs of various sorts, including but not limited to chives, herbs, carrots and the like.

The sharp lower edge 20 may be serrated in other embodiments.

Various modifications may be made to the described embodiment without departing from the scope of the invention as defined by the accompanying claims.

The invention claimed is:

1. A knife having a handle and a blade, the blade having a handle abutment portion and a main body portion having two sides, an upper edge and a sharp lower edge for cutting, wherein the blade includes at least two indentations which are spaced apart from one another, wherein at least one of the indentations is formed in the upper edge of the blade and at least one other of the indentations is formed in a top portion of the handle abutment portion adjacent to a forward region of the handle for engagement by a thumb or finger of a hand of a user gripping the handle, wherein the indentation formed in the upper edge of the blade has a radius larger than a radius of said at least one other indentation, for engagement by at least two fingers of the other hand of the user, and wherein an upper side of the handle has a portion adjacent to the handle abutment portion of the blade, and wherein the upper side of the handle is aligned to be level with the upper edge of the blade, when viewed sideways from a left side towards a right side of the knife.

2. The knife as claimed in claim 1 in which the indentation located adjacent to the forward region of the handle, when viewed sideways from the left side towards the right side of the knife, has a cross-section which is curved and concave.

3. The knife as claimed in claim 2 in which the cross-section has a portion which is circular, with a radius from 1 cm to 2 cm for engagement by the thumb or the finger of the hand gripping the handle.

4. The knife as claimed in claim 1 in which each of the two sides of the blade includes a flat main portion;

in which the flat main portions of the two sides are arranged tapering towards each other in a downward direction towards the sharp lower edge;

in which the upper edge and the sharp lower edge of the knife meet at a point.

5. The knife as claimed in claim 4 in which the at least one indentation formed in the upper edge of the blade is located nearer the point than where the flat main portions end near the handle.

6. A knife as claimed in claim 4 in which the curvature of the sharp lower edge of the blade is greater below the indentation formed in the upper edge of the blade than the curvature of the sharp lower edge at a point nearer the handle.

7. The knife as claimed in claim 4 in which the indentation formed in the upper edge of the blade, when viewed sideways from the left side towards the right side of the knife, has a cross-section which is curved and concave.

8. The knife as claimed in claim 1 in which a length of the indentation formed in the upper edge of the blade along a length of the upper edge is more than 2 cm.

9. The knife as claimed in claim 1 in which the upper edge of the blade has a distinct width and is blunt at least in the region of the indentation formed therein.

10. The knife as claimed in claim 1 in which the blade has a first end forming a point of the blade and a second end which is adjacent to the handle;

in which the at least one indentation formed in the upper edge of the blade is located nearer the first end of the blade than the second end of the blade.

11. The knife as claimed in claim 10, in which the upper edge of the blade has a first portion extending from the first end of the blade to said at least one indentation formed in the upper edge of the blade and a second portion which is straight when viewed in a direction sideways from the left side towards the right side of the knife and extends from the second end of the blade to said at least one indentation formed in the upper edge of the blade.

12. The knife as claimed in claim 11, in which the second portion of the straight upper edge of the blade extends over at least or more than half of the length of the upper edge of the blade.

13. The knife as claimed in claim 12, in which the first and second portions of the straight upper edge of the blade are aligned to be level and parallel with each other, when viewed sideways from the left side towards the right side of the knife.

14. The knife as claimed in claim 1 in which the upper edge of the blade, when viewed sideways from the left side towards the right side of the knife, is straight except for said at least one indentation formed in the upper edge of the blade.

15. The knife as claimed in claim 1 in which the lower edge of the blade tapers upwards to meet the upper edge of the blade at a point.

16. The knife as claimed in claim 1 in which an upper edge of the at least one indentation formed in the upper edge of the blade is unitary with and fabricated from the same material as the blade, and is configured for direct contact with said other hand of the user.

17. The knife as claimed in claim 1, in which in a cross-section across the knife perpendicular to its longitudinal direction and through sideways across the knife, the indentation located adjacent to the forward region of the handle is concave, or slightly convex, or flat.

18. A knife as claimed in claim 17, in which in said cross-section, the at least one indentation located adjacent to the forward region of the handle has a distinct curvature or shape which is different from portions of the handle on either side thereof;

and in which the at least one indentation located adjacent to the forward region of the handle encompasses only a partial segment of the perimeter of said cross-section.

19. The knife as claimed in claim 1 in which the sharp lower edge of the blade has a rear end portion, an imaginary line of extension of which, in a rearward direction away from a point of the knife, extends below the handle.

20. A knife having a body with a blade, the blade having a handle abutment portion and a main body portion having two sides, an upper edge and a sharp lower edge for cutting, wherein the upper edge of the blade includes at least a first indentation, wherein each of the two sides of the main body portion of the blade includes a flat main portion, the upper edge and the sharp lower edge of the knife meet at a point, and the first indentation is nearer the point than a rear end of each flat main portion, wherein a second indentation is formed in a top surface of the handle abutment portion, and a radius of the second indentation is smaller than a radius of the first indention, and wherein the knife further comprises a handle, wherein an upper side of the handle has a portion adjacent to the handle abutment portion of the blade which is aligned to be level with the upper edge of the blade, when viewed sideways from a left side towards a right side of the knife.

21. The knife as claimed in claim 20 in which the upper edge of the blade, when viewed sideways from the left side towards the right side of the knife, is substantially straight except for said first indentation, which is formed in the upper edge of the blade.

22. A knife as claimed in claim 20, in which the upper edge of the blade has a first portion extending from the point of the blade to said first indentation formed in the upper edge of the blade, and a second portion which is straight when viewed in a direction sideways from the left side towards the right side of the knife and extends from one end of the blade to said first indentation formed in the upper edge of the blade.

23. The knife as claimed in claim 22, in which the second portion of the upper edge of the blade extends over at least or more than half of the length of the upper edge of the blade.

24. A knife as claimed in claim 22 in which the first and second portions of the substantially straight upper edge of the blade are aligned to be level and parallel with each other, when viewed sideways from the left side towards the right side of the knife.

* * * * *